US005224435A

United States Patent [19]

Kinnaird

[11] Patent Number: 5,224,435

[45] Date of Patent: Jul. 6, 1993

[54] FIN BOX ASSEMBLIES FOR WINDSURFERS

[76] Inventor: Andrew T. Kinnaird, Lower Crenver, Praze, Cornwall TR14 0PA, England

[21] Appl. No.: 882,119

[22] Filed: May 13, 1992

[30] Foreign Application Priority Data

May 21, 1991 [GB] United Kingdom ..... 9110937

[51] Int. Cl.[5] ..... B63B 3/38; B63B 41/00; B63B 35/79; B63B 1/28

[52] U.S. Cl. ..... 114/127; 114/39.2; 114/130; 114/282; 114/280

[58] Field of Search ..... 114/127, 280, 282, 39.2, 114/130, 131, 132, 133, 136-139, 152, 162

[56] References Cited

U.S. PATENT DOCUMENTS

| | | | |
|---|---|---|---|
| 3,902,441 | 9/1975 | Scholle | 114/127 |
| 4,377,124 | 3/1983 | Guigan | 114/127 |
| 4,421,492 | 12/1983 | Leva | 114/127 |
| 4,805,546 | 2/1989 | Geller et al. | 114/127 |

FOREIGN PATENT DOCUMENTS

| | | | |
|---|---|---|---|
| 491811 | 3/1977 | Australia . | |
| 0017231 | 4/1980 | European Pat. Off. . | |
| 0416442 | 3/1991 | European Pat. Off. | 441/79 |
| 0420444A1 | 4/1991 | European Pat. Off. . | |
| 9013472 | 11/1990 | PCT Int'l Appl. | 441/79 |

*Primary Examiner*—Joseph F. Peters, Jr.
*Assistant Examiner*—Kenneth Lee
*Attorney, Agent, or Firm*—Melvin I. Stoltz

[57] ABSTRACT

A windsurfer board is formed, towards the tail end thereof, with a slot in which a box is fitted. The box provides a mounting for a fin which is movable, while in use, relative to the board in such manner as to permit simultaneous adjustment of the inclination of the fin relative to the board and of the extent by which the fin projects downwardly beneath the board. The mounting for the fin includes a bracket pivotally connected to the box and to the fin.

6 Claims, 4 Drawing Sheets

FIN BOX ASSEMBLIES FOR WINDSURFERS

FIELD OF THE INVENTION

This invention relates to fin box assemblies for windsurfers.

BACKGROUND OF THE INVENTION

One form of windsurfer fin box is described in European Patent Specification No. 0 088 430 and includes a box which is located towards the rear of the board and provides a pivot mounting for a fin which projects downwardly below the board and can be fixed in any one of a plurality of selected angular positions.

The degree of adjustability of the fin is, however, limited, the mechanism is complex and the commercial success of this fin box has accordingly been rather limited.

Waterboards having pivotally mounted fins are known from International Patent Specifications Nos. WO 87/04399 and WO 8/09744. Sailboards having a centrally located pivotally mounted centreboard are also known from U.S. Pat. No. 4,667,615 and European Patent Specification No. 0 416 442.

The present invention is, however, specifically concerned with fin box assemblies which are mounted towards the rear of a windsurfer board and to windsurfer boards provided with such fin box assemblies.

It is an object of the present invention to provide an improved form of fin box assembly for a windsurfer which is compact, permits ready adjustment of the position of the fin and is more effective than previous fin box designs.

A further object of the invention is to provide a windsurfer including a fin box assembly having an adjustably mounted fin, which windsurfer can be sailed more effectively in a variety of wind conditions than other windsurfers.

SUMMARY OF THE INVENTION

According to one aspect of the present invention there is provided a fin box assembly for mounting towards the rear of a windsurfer board, said fin box assembly comprising a box and a fin, the box including spaced side walls and end walls defining a chamber, and the fin being located within and depending downwardly from the chamber, said fin having a leading edge and a trailing edge, a link pivotally mounted on the box and a pivotal connection between the link and the fin, said fin, link and box being so designed that the link is movable between and locatable in first and second limiting positions, in the first of which the leading edge of the fin extends substantially vertically and in the second of which the leading edge of the fin is raked rearwardly, said fin being displaced bodily upwardly during movement of the link from its first into its second position.

According to a second aspect of the present invention there is provided a fin box assembly for mounting towards the rear of a windsurfer board, said fin box assembly comprising:

a) a box, b) a fin, c) a pair of spacers, d) a seal, and e) mounting means for the fin, the box including a pair of spaced side walls and a pair of spaced end walls defining a chamber, the fin being located within and depending downwardly from the chamber, said fin having a leading edge and a trailing edge, said spacers being formed of a low friction plastics material and located between the fin and each of the side walls of the box, the seal being formed of a resiliently deformable foamed plastics material which is fitted around the fin and acts between the fin and the walls of the box to prevent the flow of air through the box, and the mounting means for the fin permitting movement of the fin relative to the box between a first position in which the leading edge of the fin extends substantially vertically and a second position in which the leading edge of the fin is raked rearwardly, said fin being displaced bodily upwardly relative to the box during movement thereof from its first into its second position, said spacers acting to facilitate sliding of the fin relative to the box side walls and the seal flexing to maintain its sealing action during such movement of the fin.

A loop which can be grasped manually is preferably attached to the fin adjacent the upper end thereof so that a user of the windsurfer board can grasp the loop during sailing to move the fin from its first position into its second position, such movement of the fin comprising a lifting component and a tilting or pivoting component. The upper surface of the fin is preferably so formed as to facilitate the application of foot pressure thereto so that, when it is desired to move the fin from its second position into its first position, such movement can be effected during sailing by the application of foot pressure to the upper surface of the fin.

According to a third aspect of the present invention there is provided a windsurfer board having upper and lower surfaces and provided, adjacent the rear thereof, with a fin box assembly, said fin box assembly comprising:

a) a box mounted within the board so that it is substantially flush with the upper and lower surfaces of the board, b) a fin which extends a significant amount downwardly below the lower surface of the board and which extends to an appreciably lesser extent above the upper surface of the board, and c) mounting means for the fin, the box including spaced side walls and end walls defining a chamber, the fin being located within and depending downwardly from the chamber, the mounting means comprising a bracket having spaced pivotal connections to the box and to the fin, said fin, bracket and box being so designed that the bracket is movable into and locatable in first and second positions, the first position of the bracket being one in which the trailing edge of the fin extends substantially vertically and the second position of the bracket being one in which the trailing edge of the fin is raked rearwardly, the pivotal connections between the bracket, the box and the fin being such that the fin is displaced bodily upwardly during movement of the bracket from its first into its second position.

DESCRIPTION OF THE PREFERRED EMBODIMENTS

Figure 1:
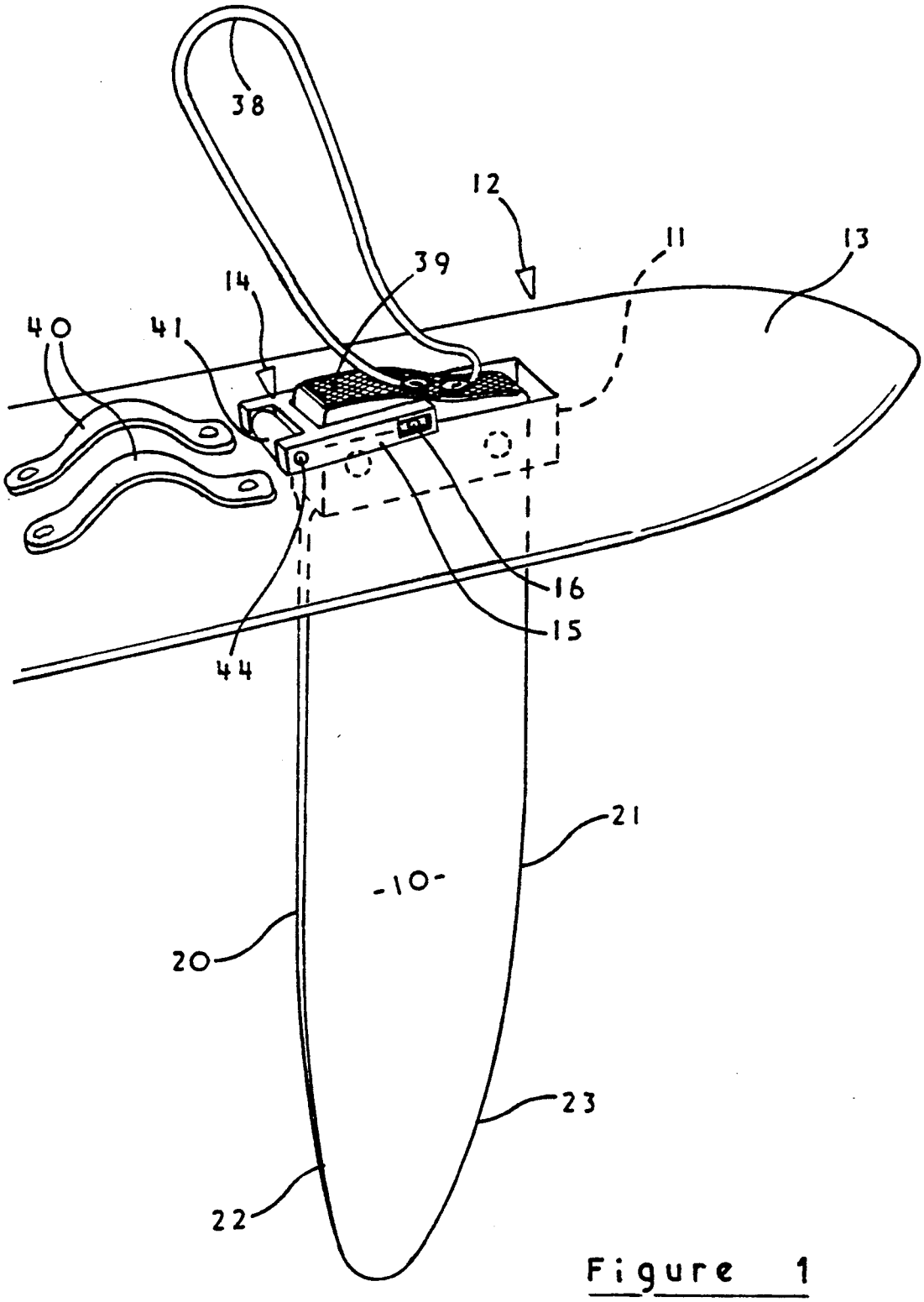
FIG. 1 is a perspective view of the rear portion of a windsurfer board fitted with a fin box assembly and showing the fin in its lowermost position.
Figure 2:
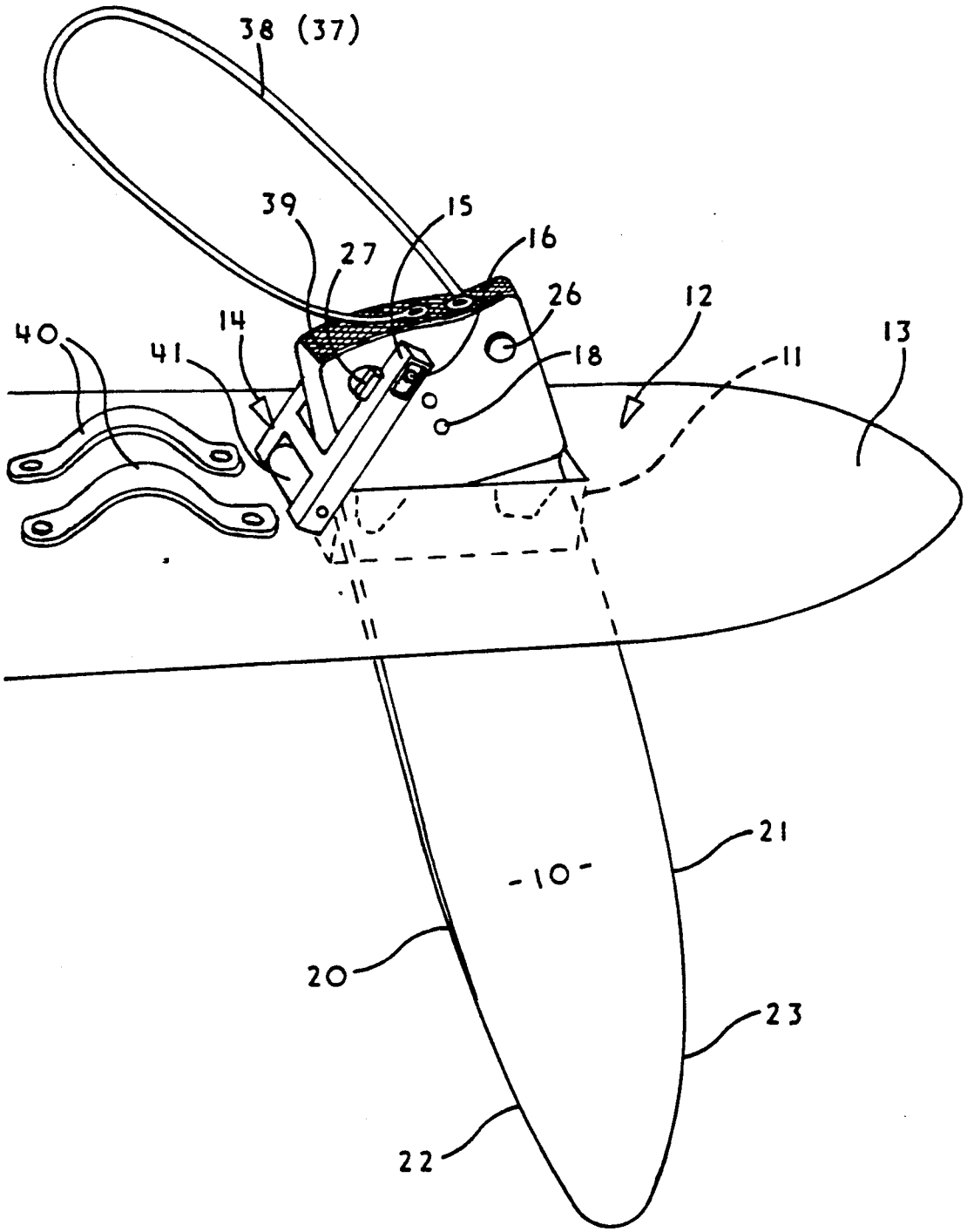
FIG. 2 is a perspective view similar to FIG. 1 but showing the fin in its raised position.
Figure 3:
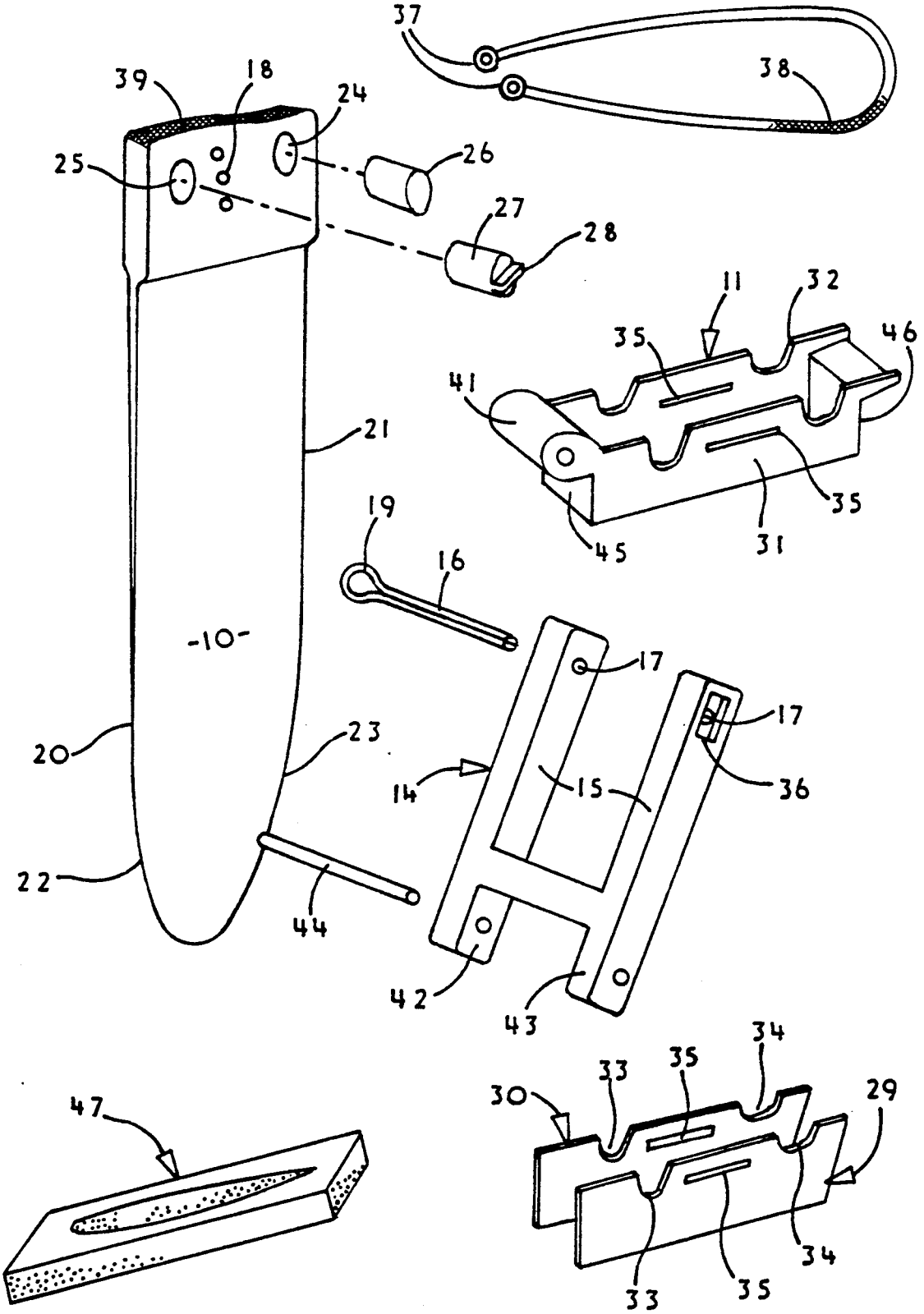
FIG. 3 is an exploded perspective view of the fin and its mounting means.

The fin 10 shown in FIGS. 1 to 3 is of aerofoil configuration and is formed of a carbon fibre or mesh-reinforced polyester resin or other equally strong and durable semi-rigid plastics material. It is located within a rectangular box 11 fixed within an elongated slot formed in the windsurfer board 12 towards the rear or tail end 13 of the board 12. The box 11 has walls formed either of metal plate or of a glass-fibre-reinforced polyester resin and is bonded in position within the slot in the board 12 so that the upper surface of the box 11 extends just above the upper surface of the board 12 and the lower surface of the box 11 is spaced upwardly a short distance from the lower surface of the board 12.

The mounting for the fin 10 includes a U-shaped bracket 14 which has a pair of parallel arms 15 which fit one on each side of the fin 10 and are pivotally connected to the fin 10 by means of a pin 16 which passes through aligned apertures 17 formed in the arms 15 adjacent the ends thereof and an aperture 18 formed in the fin 10. The pin 16 has an enlarged head portion 19 to facilitate removal of the pin 16 if, for example, it is desired to replace the fin 10 by one of greater or lesser length or, as described below with reference to FIGS. 4 and 5, to replace the adjustable fin 10 by a fixed fin.

In practice, the overall length of the fin 10 which is chosen will depend on the area of sail carried by the windsurfer board and this will depend not only on the wind conditions but also on the weight and sailing ability of the person using the windsurfer board. For a larger area of sail, a longer fin will be used As shown in the drawings, a small number of spaced apertures 18 may be formed in the fin 10 so that, by appropriate selection of the aperture 18 in which the pin 16 is to be fitted, a degree of adjustment of the effective fin area can be achieved. Such adjustment will be effected out of the water and will depend on the individual user and on the wind and wave conditions.

The fin 10 has a leading edge 20 and a trailing edge 21 and, although the design of the fin 10 may be varied significantly, the leading edge 20 may comprise an upper straight portion followed by a relatively short lower curvate portion 22, whilst the trailing edge 21 again comprises an upper straight portion followed by a somewhat longer lower curvate portion 23.

The fin 10 is formed, adjacent its upper edge, with a pair of transverse bores 24 and 25 in which stop plugs 26 and 27 respectively are fitted so as to project beyond the adjacent surfaces of the fin 10 and on each side of the fin 10. The plug 26 which is closer to the trailing edge 21 of the fin 10 is a simple cylindrical plug whereas the plug 27, which is closer to the leading edge 20 of the fin 10, is provided at each end with a raised projection 28 of square cross-section positioned so that, when the fin 10 is in its raised position as shown in FIG. 2, each projection 28 engages the associated arm 15 of the bracket 14 to limit the extent of movement of the bracket 14 and hence of the fin 10.

Spacers 29 and 30 are fitted within the box 11, one adjacent each of the side walls 31, 32 of the box. The spacers 29 and 30 are formed of a material having a low coefficient of sliding friction with the fin 10, the preferred material being ultra high molecular weight polyethylene, though other low friction materials, for example polytetrafluoroethylene, could also be used. Each of the spacers 29, 30 is in the form of a generally flat plate of the configuration shown in FIG. 3.

Figure 4:
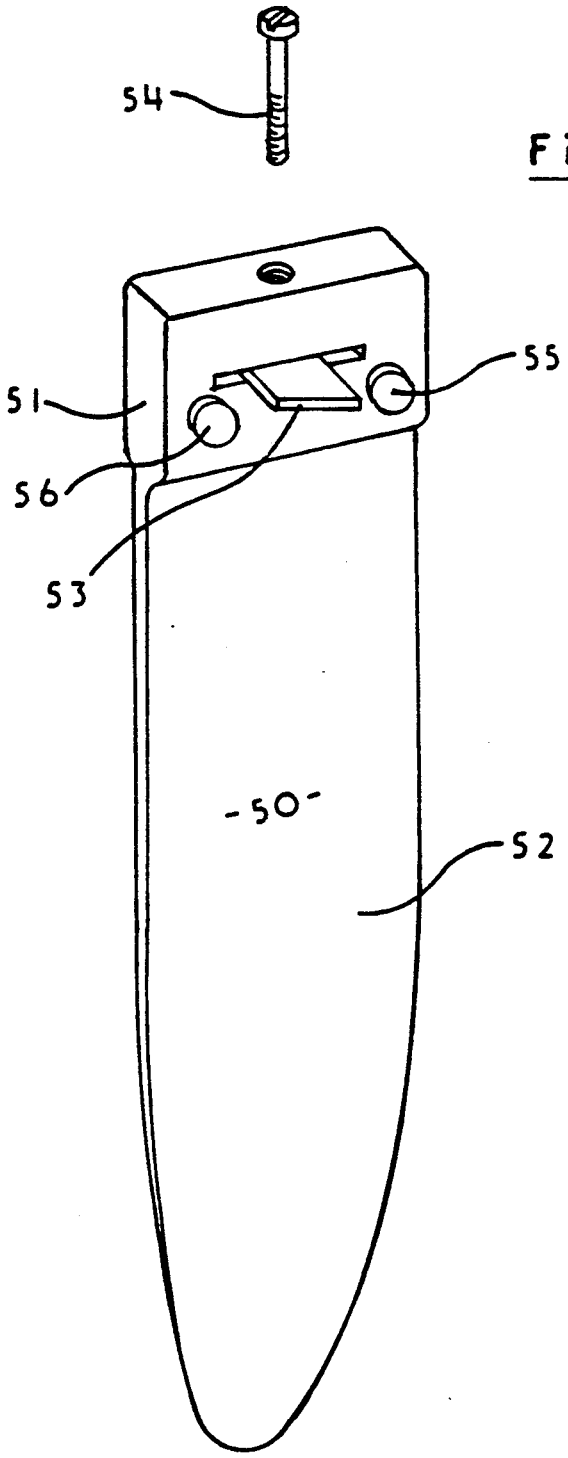
FIG. 4 is a perspective view similar to FIG. 1 but showing an alternative form of fin.
Figure 5:
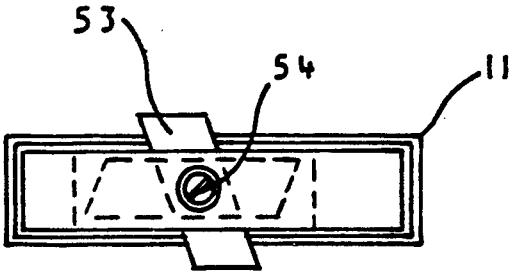
FIG. 5 is a detail view showing the mounting of the fin shown in FIG. 4.

The upper edge of each spacer 29, 30 is thus provided with a pair of spaced rebates 33, 34 which are aligned with corresponding rebates 33, 34 formed in the side walls 31 and 32 of the box 11. The spacings between the rebates 33, 34 correspond to the spacing between the plugs 26 and 27. Thus, when the fin is in its lowermost position as shown in FIG. 1, the plugs 26 and 27 sit in the rebates 33, 34 in the spacers 29 and 30 and in the aligned rebates 33, 34 in the box side walls 31 and 32, which rebates act as locating elements for the fin 10. Each spacer 29, 30 and each box side wall 31, 32 is also formed with a cut-out 35 which acts (as described below) as a locating formation when a fixed fin is used (as shown in FIGS. 4 and 5) in place of the fin 10 of FIGS. 1 to 3.

In production, there will inevitably be variations in the transverse spacings of the side walls 31 and 32 of the box 11 and in the thickness of the fin 10. The spacers 29 and 30 may thus additionally act as shims and, as appropriate, two or more spacers will be used to ensure that the fin 10 is a close sliding fit between the walls 31 and 32 of the box 11. As an alternative to using different numbers of spacers 29, 30, it is also possible to provide spacers of different thicknesses or to provide separate shims. This will be of advantage if, for example, a fin box assembly is provided which includes a plurality of alternatively usable fins which are of different lengths and of different thicknesses.

One of the arms 15 of the bracket 14 is formed with a seating 36 in line with the through aperture 17 which receives the pin 16. The pin 16 can be a drop-nose pin and the seating 36 will then receive the drop-nose formation of the pin 16 to receive and locate it in position.

The upper surface 39 of the fin 10 is formed with a pair of spaced recesses each of which receives a tag 37 attached to a lifting loop 38 which projects above the fin 10. The tags 37 are fixed in position by suitable pins (not shown). The lifting loop 38 may comprise a tube of polyvinyl chloride with a fabric covering of, for example, polyethylene terephthalate.

The upper surface 39 of the fin 10 is of a non-slip nature and this may be afforded by, for example, bonding a layer of non-slip material to the upper edge of the fin 10. The upper surface 39 is proud of the box 11 when the fin 10 is in its raised position as shown in FIG. 2.

When the windsurfer is being sailed up-wind, the fin 10 will be in its lowermost position as shown in FIG. 1. The fin 10 will project downwardly a substantial distance below the board 12 and will accordingly provide substantial transverse reaction in respect of the transverse forces to which the sail and board are subjected while sailing up-wind. The area of the fin 10 which is in the water and the depth of downward projection of the fin 10 provide additional lift and enhance the pointing ability of the board 12 to enable the board to be sailed up-wind more efficiently than would otherwise be the case.

At the end of the up-wind leg, the windsurfer will bear off slightly to reduce the pressure on the fin 10 and bend down to grasp the lifting loop 38. An upward lifting action will then serve to move the fin from its lowermost position as shown in FIG. 1 into its raised position as shown in FIG. 2 in readiness for sailing the board along the down-wind leg. As shown in FIG. 2, the fin 10 is not only displaced bodily upwardly but is also raked rearwardly as compared to its FIG. 1 position thereby effecting a very substantial reduction in the extent by which the fin 10 projects downwardly below the board 12 and in the degree of lift arising from the presence of the fin.

At the end of the down-wind leg, the person sailing the board will apply foot pressure to the non-slip upper surface 39 and, by pressing downwardly, will move the fin 10 from its raised position back into its lowermost position. The increase in the effective area of the fin 10 which is then achieved by pivoting the fin 10 back into a substantially vertical position as well as displacing the fin 10 bodily downwardly is considerably greater than would be the case if the fin 10 were merely pivoted forwardly into a generally vertical position.

As shown in the drawings, the fin box assembly is located centrally of the board 12 just to the rear of the foot straps 40. The upper edges of the walls of the box 11 will be sanded or ground away so that they lie either flush with the upper surface of the board 12 or project just above the upper surface of the board 12. In this respect, a small degree of projection above the upper surface of the board 12 is to be regarded as "substantially flush" with said upper surface.

The box 11 includes a boss 41 which fits between forwardly extending stubs 42 and 43 of the bracket 14 with a pin 44 extending through aligned bores in the boss 41 and the stubs 42 and 43 to provide for the pivotal mounting of the bracket 14. In a typical construction, the axis of the pin 44 is located approximately 0.3 inches above the upper surface of the board 12.

The front and rear walls 45 and 46 of the box 11 can be inclined rearwardly so that, when the fin 10 is moved into its rearwardly raked position as shown in FIG. 2, the leading and trailing edges 20 and 21 of the fin 10 will lie in substantial contact with the walls 45 and 46. The walls 45 and 46 will thus act as stops. In addition, the close spacing between the leading and trailing edges 20 and 21 of the fin 10 and the walls 45 and 46 will reduce the tendency for the generation of a downward flow of air through the box 11 during the high-speed down-wind leg.

This downward flow of air is further prevented by means of a sealing gasket 47 which is bonded to the downwardly facing surfaces of the walls of the box 11 and is formed of a resiliently deformable foamed plastics material, such as a foamed polyurethane or a foamed silicone rubber. The sealing gasket 47 is shaped so that it is a close fit around the fin 10 whilst the resilient nature of the gasket material enables the gasket 47 to flex and maintain its sealing action during movement of the fin 10 between its lowermost position as shown in FIG. 1 and its raised position as shown in FIG. 2.

The walls of the box 11 and the spacers 29 and 30 have a height which is slightly less than the thickness of the board 12. The lower surfaces of the walls of the box 11 are spaced upwardly from the lower surface of the board 12 by a distance corresponding to the thickness of the gasket 47 and a flush-fitting arrangement is thus provided.

Turning next to FIGS. 4 and 5, these show the provision of an additional fixed fin 50 which can be installed in place of the adjustable fin 10. The fin 10 can be removed, as explained above, by withdrawing the pin 16 from apertures 17 and 18. The fixed fin 50, which can be fitted in position in place of fin 10, includes an upper portion 51 which is of increased thickness as compared to the remainder 52 of the fin 50 which, as shown, is of an appropriate streamlined configuration.

The upper portion 51 of the fin 50 is formed with a transverse slot within which is mounted a clamping plate 53 which is rotatable between a projecting locking position (as shown) and a release position. Such rotation of the clamping plate 53 is effected by means of a locking screw 54 which can be tightened by means of a screwdriver or similar tool so that the ends of the plate engage within the cut-outs or locating formations 35 in the spacers and box side walls 31, 32.

The upper portion 51 of the fin 50 is formed with spaced transverse bores in which depth stop plugs 55 and 56 are fitted. These plugs 55 and 56 engage in the rebates 33 and 34 in the spacers and in the aligned rebates in the box side walls 31 and 32. A sealing gasket (not shown) corresponding to sealing gasket 47 is again fitted around the fin 50 to prevent the down-flow of air through the box. The length of the fin 50 will be chosen so as to obtain an acceptable compromise performance, providing substantial lateral restraint during the up-wind leg without excessive drag and lift during the downwind leg.

I claim:

1. A windsurfer board having upper and lower surfaces and provided, adjacent the rear thereof, with a fin box assembly, said fin box assembly comprising:

a) a box mounted within the board so that it is substantially flush with the upper and lower surfaces of the board, b) a fin which extends a significant amount downwardly below the lower surface of the board and which extends to an appreciably lesser extent above the upper surface of the board and c) mounting means for the fin, the box including spaced side walls and end walls defining a chamber, the fin being located within and depending downwardly from the chamber, the fin having a leading edge and a trailing edge, the mounting means comprising a bracket having spaced pivotal connections to the box and to the fin, said fin, bracket and box being so designed that the bracket is movable into and locatable in first and second positions, the first position of the bracket being one in which the trailing edge of the fin extends substantially vertically and the second position of the bracket being one in which the trailing edge of the fin is raked rearwardly, the pivotal connections between the bracket, the box and the fin being such that the fin is displaced bodily upwardly during movement of the bracket from its first into its second position.

2. A windsurfer board according to claim 1, in which renewable plastic spacers are located between the fin and the side walls of the box, and in which a sealing gasket of a resiliently deformable material is fitted around the fin to provide a seal between the fin and the walls of the box.

3. A windsurfer board according to claim 2, in which the fin is provided with stop plugs for limiting the extent of movement of the fin and hence of the bracket relative to the board, at least one stop plug being arranged for engagement with the box when the bracket is in its first position and at least one stop plug being arranged for engagement with the bracket when the bracket is in its second position.

4. A windsurfer board according to claim 2, in which the side walls of the box and the spacers are provided with locating formations and the fin is removable, said board being provided in combination with an additional fin which can be fitted in the box in place of the original fin after removal of the original fin, the additional fin carrying a clamping plate movable between a locking and a release position, the clamping plate being arranged so that, in its locking position, it engages with the locating formations to fix the additional fin in position in the box.

5. A windsurfer board according to claim 1, in which the leading edge of the fin comprises:

a) a substantially straight upper portion, which upper portion is disposed substantially vertically when the bracket is in its first position, and b) a curvate lower portion which merges with the upper portion and extends arcuately rearwardly relative to the upper portion.

6. A windsurfer board according to claim 1, in which the upwardly facing portion of the fin has a non-slip surface so as to facilitate the application of foot pressure thereto so that, when it is desired to move the bracket from its second position into its first position, such movement can be effected during sailing by the application of foot pressure to the upper surface of the fin.

* * * * *